US005958269A

United States Patent [19]

Suzuki et al.

[11] Patent Number: 5,958,269

[45] Date of Patent: Sep. 28, 1999

[54] TONER FIXING HEATER DEVICE HAVING INCLINED HEATER ELECTRODE ENDS

[75] Inventors: Makoto Suzuki, Nagoya; Rikuzou Kouzuki, Kobe, both of Japan

[73] Assignees: Brother Kogyo Kabushiki Kaisha, Nagoya; Bando Chemical Industries, Ltd., Kobe, both of Japan

[21] Appl. No.: 08/961,026

[22] Filed: Oct. 30, 1997

[30] Foreign Application Priority Data

Nov. 11, 1996 [JP] Japan ..... 8-315445

[51] Int. Cl.[6] ..... G03G 15/20; H01R 39/04

[52] U.S. Cl. ..... 219/216; 219/469; 399/331; 310/236

[58] Field of Search ..... 219/216, 469–471; 399/330–334; 310/233, 236; 432/60, 228; 492/46; 118/60

[56] References Cited

U.S. PATENT DOCUMENTS 5,420,392 5/1995 Sakata ..... 219/216
5,532,807 7/1996 Takemoto ..... 219/216
5,575,942 11/1996 Watanabe .
5,729,814 3/1998 Suzuki et al. ..... 399/333

FOREIGN PATENT DOCUMENTS

A-62-279378 12/1987 Japan .

*Primary Examiner*—Joseph Pelham
*Attorney, Agent, or Firm*—Oliff & Berridge, PLC

[57] ABSTRACT

In a toner-fixing heater device, a heater strip in a meandering pattern and a pair of heater electrodes are formed on an insulator film which is in turn fixed to a cylindrical roller body. Each heater electrode which slidably contacts a brush electrode has a leading and trailing edges formed inclinedly at an inclination angle θ, e.g., 50°. The axial width Wd of the heater electrode 14, the circumferential width Wg of a spacing between the leading and the trailing edges, and the circumferential width Wb of the brush electrode are determined to satisfy (Wd/tan θ+Wd)≧Wg. This arrangement assures a continuous sliding contact between the heater electrode and the brush electrode.

20 Claims, 2 Drawing Sheets

TONER FIXING HEATER DEVICE HAVING INCLINED HEATER ELECTRODE ENDS

CROSS REFERENCE TO RELATED APPLICATION

This application is related to and incorporates herein by reference Japanese Patent Application No. 8-315445 filed on Nov. 11, 1996.

BACKGROUND OF THE INVENTION

1. Field of the Invention

The present invention relates to a toner-fixing heater device and, more particularly to a heater roller of the type in which a resistor heater body attached to the inner circumferential surface of a roller body is energized to heat toner deposited on a printing medium for fixing.

2. Description of Related Art

In conventional image printing apparatus such as laser printers and photo copiers, a printing mechanism and a fixing mechanism are provided for depositing toner on a printing medium based on an image signal and for fixing the deposited toner to the printing medium, respectively. The fixing mechanism includes generally a toner-fixing heater roller and a presser roller pressed to the toner-fixing heater roller to heat and fix the deposited toner to the printing medium while feeding the printing medium therebetween.

The toner-fixing heater roller is provided on its roller body with a resistor heater body which is energized for heating up to a temperature (e.g., 140° C.) required for the toner fixing in a short period of time.

JP-A 62-279378 discloses one type of toner-fixing heater roller in which an insulator film layer is formed on the inner circumferential surface of a cylindrical roller body and a resistor heater body layer is formed on the inner circumferential surface of the insulator film layer. Inside the roller body, a pair of ring-shaped electrically conductive members are contacted to the resistor heater body layer to supply the electric power to the resistor heater body for heating. This type of the toner-fixing heater roller, however, requires a very complicated work for forming the insulator film layer on the roller body and then forming the resistor heater body layer on the insulator film layer. In addition, it requires a very complicated structure of the ring-shaped electrically conductive member which is contacted to the resistor heater body layer.

JP-A 8-194401 (U.S. Pat. No. 5,575,942) discloses another type of toner-fixing heater roller in which a resistor heater body is constructed by a strip heater meandering in a predetermined pattern and a pair of generally ring-shaped heater electrodes formed integrally on both sides of the strip heater. The resistor heater body is fixed to an insulator film layer, thereby forming a resistor heater sheet. This resistor heater sheet is attached to the inner circumferential surface of a roller body so that the resistor heater body heats when the electric power is supplied to the heater electrodes by contacting brush electrodes.

In this type of the toner-fixing heater roller, a discontinuous part is formed at one circumferential location where a pair of circumferential ends of each heater electrode reside, so that the resistor heater sheet is fixed to the inner circumferential surface of the roller body. This discontinuous part is formed to extend in an axial direction perpendicular to the circumferential direction of the roller body, i.e., at the right angle relative to the sliding contact direction of the brush electrode. The heater electrode receives a greater contact force when the brush electrode slidingly moves from the discontinuous part to its circumferential end. Thus, the discontinuous part impedes smooth sliding of the brush electrode and causes wear in the heater electrode. Further, it causes electric noises when the brush electrode fails to contact the heater electrode temporarily.

SUMMARY OF THE INVENTION

It is therefore an object of the present invention to improve the foregoing disadvantages, that is, to provide a toner-fixing heater device in which wear of a heater electrode at around longitudinal ends of the heater electrode and electric noises resulting from a contact failure of a brush electrode thereat are reduced.

According to the present invention, in a toner-fixing heater device having a resistor heater body which is constructed integrally by a meandering heater strip and a heater electrode, the heater electrode is formed to have a pair of inclined longitudinal ends which extends in a direction inclinedly crossing a longitudinal direction of the heater electrode and parallelly to each other. The resistor heater body is provided on a cylindrical roller so that the heater electrode is provided generally in a ring shape. The longitudinal ends provide a part which enables a brush electrode to contact the heater electrode continuously during the sliding movement.

Preferably, the heater strip and the heater electrode are formed on an insulator film and, thereafter, the insulator film is attached to a cylindrical roller body.

The inclined longitudinal ends are separated from each other circumferentially to provide a discontinuous heater electrode part therebetween on the roller body.

Alternatively, one inclined longitudinal end is overlaid on the other inclined longitudinal end to provide a continuous heater electrode part. Preferably, one of the inclined longitudinal ends which the brush electrode contacts first is covered by the other of the inclined longitudinal ends.

BRIEF DESCRIPTION OF THE DRAWINGS

Other objects, features and advantages of the present invention will become more apparent from the following detailed description when read with reference to the accompanying drawings, in which.

DETAILED DESCRIPTION OF THE PRESENTLY PREFERRED EMBODIMENTS

The present invention will be described with reference to an embodiment and its modification which are applied to an image printing apparatus such as a laser printer or a photo copier which uses toner.

Figure 1:
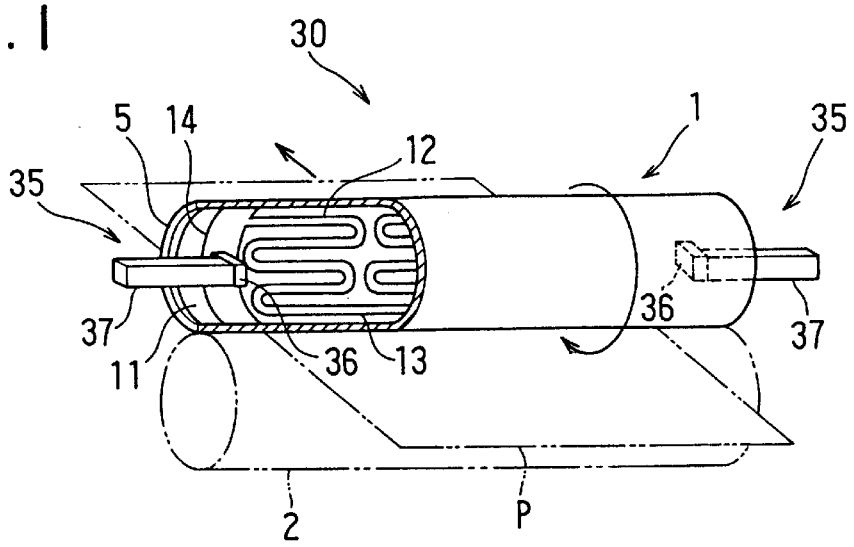
FIG. 1 is a perspective view, partly in section, showing a toner-fixing heater roller according to an embodiment of the present invention.

Referring first to FIG. 1, a toner-fixing device 30 has a toner-fixing heater roller 1 rotatably supported by a support member (not shown) and a presser roller 2 made of rubber and pressed to the toner-fixing heater roller 1. The toner-fixing heater roller 1 and the presser roller 2 sandwich and feed a paper (printing medium) P therebetween to fix the toner onto the paper while heating the same.

Figure 2:
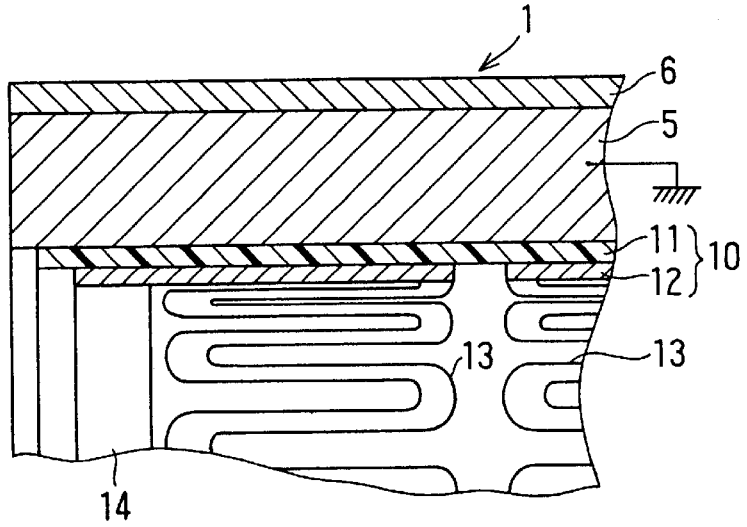
FIG. 2 is a sectional view of a part of the toner-fixing heater roller shown in FIG. 1.

As shown in FIG. 2 further in detail, the toner-fixing heater roller 1 has a cylindrical roller body 5, a deposit restrictor layer 6 fixed to the outer circumferential surface of the roller body 5 and a resistor heater sheet 10 adhered to the inner circumferential surface of the roller body 5. The roller body 5 is made of an aluminum having a good electric conductivity and electrically grounded. The deposit restrictor layer 6 is made of fluorine-contained resin such as a Teflon coating of 10–20 μm thickness which has a high heat resistivity and is restrictive to toner deposition deposited on the paper P.

Figure 3:
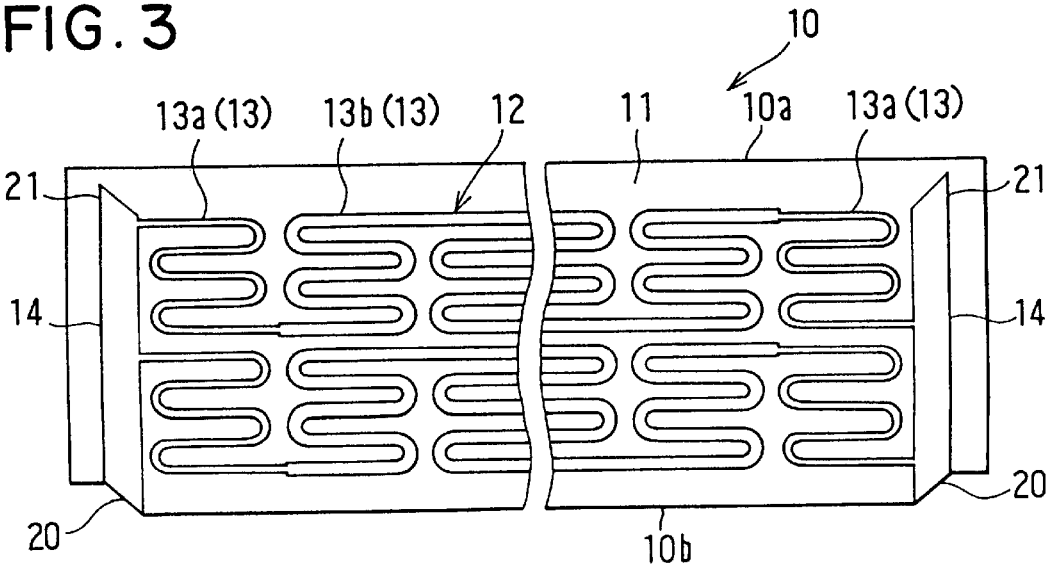
FIG. 3 is a plan view of a resistor heater sheet used in the toner-fixing heater roller shown in FIG. 1.

As shown in FIG. 3 further in detail, the resistor heater sheet 10 has a generally rectangular-shaped insulator film 11 which is to be fixed to the inner circumferential surface of the roller body 5 and is made of a heat-resisting and insulating polyimide resin of 30–50 μm thickness, and a foil-type resistor heater body 12 fixed on the flat surface of the insulator film 11 and made of a stainless steel of 30–50 μm thickness. The resistor heater body 12 has heater strips 13 each of which is arranged to meander in a predetermined zig-zag or serpentine pattern and a pair of longitudinally extending heater electrodes 14 formed on both axial sides (right and left sides in FIGS. 1 through 3) of the heater strip 13 integrally with the heater strip 13.

A pair of power supply mechanisms 35 (FIG. 1) are provided at both axial ends of the toner-fixing heater roller 1 for supplying the electric power to the resistor heater body 12 of the resistor heater sheet 10. Each power supply mechanism 35 has a carbon brush electrode 36 slidably contacting the heater electrode 14 of the resistor heater body 12, an insulating bar 37 fixedly supporting the brush electrode 36 at an end thereof, a biasing member (not shown) biasing the brush electrode 36 toward the heater electrode 14 through the bar 37 and the like. The brush electrode 36 is connected electrically to an electric power source through an electric lead wire (not shown) passing through the bar 37.

The heater strip 13 of the resistor heater body 12 includes higher temperature heater strips 13a located axially outside (closely to the heater electrodes 14) and lower temperature heater strips 13*b* located axially inside the higher temperature heater strips 13*a* and connected in series with the higher temperature heater strips 13*a*. The higher temperature heater strip 13*a* has a strip width wider than that of the lower temperature heater strip 13*b* so that the higher temperature heater strip 13*a* has a higher resistance to generate more heat. Thus, the higher temperature heater strip 13*a* restricts the temperature from lowering around open axial ends of the roller body 5 due to the radiation of heat, thereby keeping a uniform temperature distribution all over the toner-fixing heater roller 1 so that a good printed image may be provided by the assured fixation of the toner onto the paper P.

Figure 4:
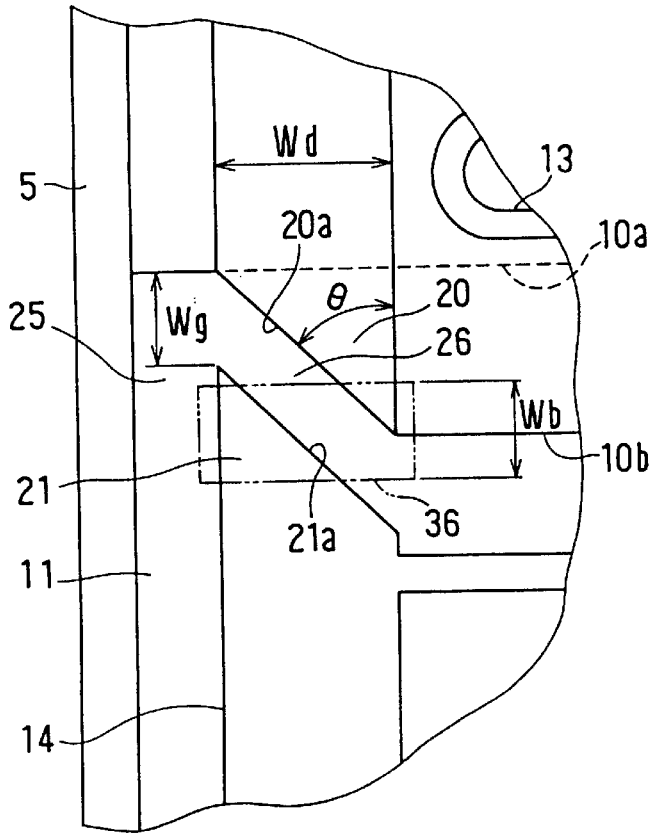
FIG. 4 is an enlarged view of the resistor heater sheet as attached to a roller body as shown in FIG. 2.

Each heater electrode 14 extends longitudinally (before being attached to the roller body 5 as in FIG. 3) or circumferentially (after being attached to the roller body 5 as in FIGS. 1 and 2) and has a first and a second triangular or inclined ends 20 and 21 at one location, i.e., at a connection part 25, where the two sides of the resistor heater sheet 10 (top and bottom sides 10*a* and 10*b* in FIG. 3) are connected when attached to the inside of the roller body 5 as shown by a dotted line in FIG. 4. The first and the second ends 20 and 21 are formed at a leading and trailing ends of the heater electrode 14 in a counter-rotating direction of the roller body 5, respectively. The first and the second ends have respective leading and trailing edges 20*a* and 21*a* which are separated from each other circumferentially to provide a discontinuous heater electrode part or spacing 26 therebetween.

The heater electrode 14 is formed to have a width Wd in the axial direction of the roller body 5 and to have a width Wg of the spacing 26 between the leading and the trailing edges 20*a* and 21*a* in the circumferential direction of the roller body 5. The leading and the trailing edges 20*a* and 21*a* are formed in parallel with each other and inclined by an angle θ (less than 90°, e.g., 50°) relative to the longitudinal direction of the heater electrode 14, i.e., the circumferential direction of the roller body 5 so that the spacing 26 extends inclinedly in the axial direction. The brush electrode 36 which slidingly contacts the heater electrode 14 has a width Wb in the axial direction of the roller body 5 and a width a little wider than the width Wd in the axial direction of the roller body 5. Those widths Wd, Wg, Wb and the inclination angle θ are determined to satisfy $(Wd/\tan\theta+Wb) \geqq Wg$, thereby assuring continuous contact of the brush electrode 36 with the heater electrode 14 even when the brush electrode 14 slidingly moves on the spacing 26.

In manufacturing the resistor heater sheet 10, a planar stainless foil is first punched into the resistor heater body 12 (heater strips 13 and heater electrodes 14) in a zig-zag shape and then the leading and trailing edges 20*a* and 21*a* of the heater electrode 14 are polished. Thereafter, the resistor heater body 12 is attached to the surface of the planar insulator film 11 made of insulating polyimide resin. Alternatively, a stainless steel foil is first attached to the surface of the insulator film 11 to provide a planar film sheet and then a resist corresponding to the zig-zag pattern of the resistor heater body 12 (heater strips 13 and heater electrodes 14) is pasted over the stainless steel foil by screen printing. Thereafter, the stainless steel foil is etched and the resist is removed, thus providing the resistor heater sheet 10 having the resistor heater body 12 on the insulator film 11. A heat-resisting adhesive is pasted over the rear surface of the insulator film 11 and the resistor heater sheet 10 is attached to the inner circumferential surface of the roller body 5 with its resistor heater body 12 being placed radially inwardly in the roller body 5. The roller body 5 is finally heated in a high temperature furnace to assure fixation of the resistor heater sheet 10 onto the roller body 5.

According to the toner-fixing heater roller 1 described above, the connection part 25 has the spacing 26 provided at one circumferential location of the heater electrode 14 and defined by two ends 20 and 21 having the respective inclined edges 20*a* and 21*a*. The spacing 26 is inclined by the angle θ relative to the longitudinal direction of the heater electrode 14, i.e., to the circumferential direction of the roller body 5. This connection part 25 reduces the contact force which exerts on the heater electrode 14 when the brush electrode 36 slides relatively from the end 20 at the leading side to the end 21 at the trailing side, i.e., downwardly in FIG. 4, thus assuring a smooth movement from the first end 20 to the second end 21. As a result, the wear of the heater electrode 14 is reduced, particularly at the end 21, and the electric noise caused by the contact failure between the heater electrode 14 and the brush electrode 36 at the spacing 26 around the connection part 25 is reduced as well.

The resistor heater sheet 10 is attached to the inner circumferential surface of the roller body 5 after the resistor heater body 12 is fixed onto the insulator film 11. Thus, the toner-fixing heater roller 1 is manufactured by a simple work of attaching the resistor heater sheet 10 in a planar sheet shape onto the roller body 5 cylindrically, resulting in low manufacturing cost.

The first and the second ends 20 and 21 of the heater electrode 14 have the respective leading and trailing edges 20*a* and 21*a* which are inclined by the angle e in parallel to each other. The connection part 25 having the spacing 26 is provided with ease when the resistor heater sheet 10 is attached in a tubular or cylindrical form to the roller body 5.

The widths Wb, wd, wg and the inclination angle θ are determined to satisfy (Wd/tanθ+Wb)≧Wg. The brush electrode 36 is enabled to come into contact with the first end 20 while maintaining the contact with the second end 21. That is, the brush electrode 36 is enabled to maintain the contact with the heater electrode 14 continuously during the rotation of the roller body 5. This will assure the suppression of electric noises which may be caused by the interruption of contact between the heater electrode 14 and the brush electrode 36.

In addition, the leading and the trailing edges 20*a* and 21*a* of the first and the second ends 20 and 21 are smoothed by polishing. This will further improve the smooth sliding contact between the heater electrode 14 and the brush electrode 36 at the connection part 25.

Figure 5:
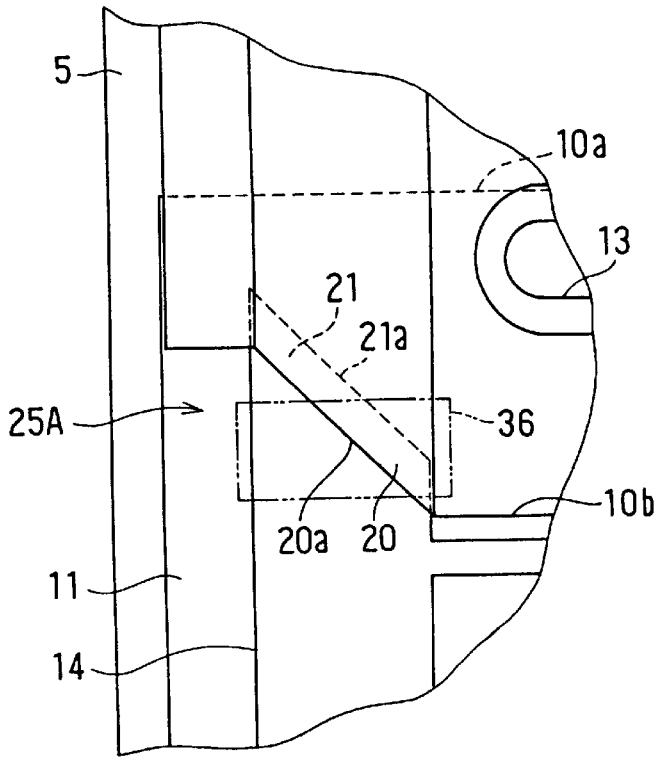
FIG. 5 is an enlarged view of a modification of the resistor heater sheet as attached to the roller body.

The foregoing embodiment may be modified as shown in FIG. 5, in which the same or like parts as in the foregoing embodiment are denoted by the same or like reference numerals.

In this modification, at a connection part 25A where the two sides 10*a* and 10*b* of the heat resistor sheet 10 are connected, the top side 10*a* is laid radially outside the bottom side 10*b* so that the second end 21 formed near the top end 10*a* is laid radially outside the first end 20. That is, the first end 20 is positioned radially inside the second end 21 so that the trailing edge 21*a* is covered by the first end 20 which is at the leading side.

According to this modification, when the brush electrode 36 slidingly moves from the leading side to the trailing side of the heater electrode 14 (downwardly in FIG. 5), the trailing edge 21*a* which is covered by the first end 20 is not caught by the brush electrode 36 and not peeled off thereby either. Further, with the overlapping part of the first and the second ends 20 and 21 extends inclinedly at the inclination angle θ relative to the longitudinal direction of the brush electrode 14 or to the circumferential direction of the roller body 5 in the same manner as in the foregoing embodiment (FIGS. 1 through 4), the brush electrode 36 is enabled to come into contact with the second end 21 gradually while maintaining the contact with the first end 20. That is, the brush electrode 36 is enabled to maintain the contact with the heater electrode 14 continuously during the rotation of the roller body 5. This will assure the suppression of electric noises which may be caused by the interruption of contact between the heater electrode 14 and the brush electrode 36.

It is to be noted in the foregoing embodiment and its modification that the resistor heater body 12 may be made of other materials such as a copper. In case of copper, it is preferred to cover it by a polyimide film coating or the like because the copper is likely to rust. The meandering pattern of the heater strip 13 may be changed to any form as long as it provides a uniform temperature distribution over the roller body 5. Fixing the resistor heater body 12 onto the insulator film 11 and fixing the resistor heater sheet 10 onto the inside surface of the roller body 5 may be attained not only by the adhesives but also by other fixing materials or processes. The heater resistor sheet 10 may be fixed on the outside surface of the roller body 5.

The present invention should not be restricted to the above disclosed embodiment and modifications but may be implemented in various other ways without departing from the spirit and scope of the invention.

We claim:

1. A toner-fixing heater device for fixing toner on a printing medium comprising:

a cylindrical roller body;

an insulator film attached to an inner circumferential surface of the roller body; and a resistor heater body shaped in a film and attached to an inner circumferential surface of the insulator film, the resistor heater body being constructed to generate heat for fixing the toner deposited on the printing medium, wherein the resistor heater body has a heater strip arranged in a meandering pattern and a plurality of ring-shaped heater electrodes formed integrally with the heater strip, each of the heater electrodes has at one circumferential location a connection part extending along an insulator film surface and inclined in a direction forming an inclination angle less than 90° relative to a circumferential direction of the inner circumferential surface of the roller body.

2. The toner-fixing heater device according to claim 1, wherein the resistor heater body is attached to the insulator film to provide a resistor heater sheet, and the resistor heater sheet is attached to the inner circumferential surface of the roller body.

3. The toner-fixing heater device according to claim 1, wherein the heater electrode has a first and a second ends at a leading and a trailing sides of the heater electrode respectively in a counter-rotating direction of the roller body.

4. The toner-fixing heater device according to claim 3, wherein a spacing is provided between the first and the second ends to extend inclinedly at the connection part.

5. The toner-fixing heater device according to claim 4, wherein a brush electrode having a circumferential width Wb is provided to slidably contact the heater electrode, and the inclination angle θ, the width Wd, a circumferential width Wg of the spacing and an axial width Wd of the heater electrode are determined to satisfy (Wd/tan θ+Wb)≧Wg.

6. The toner-fixing heater device according to claim 3, wherein the first and the second ends are overlapped at the connection part.

7. The toner-fixing heater device according to claim 6, wherein the first end is laid radially inside the second end.

8. The toner-fixing heater device according to claim 7, wherein at least one of the first and the second ends is polished.

9. The toner-fixing heater roller according to claim 1, wherein each of the heater electrodes has a leading edge and a trailing edge at circumferential ends thereof, the edges are inclined by the inclination angle and arranged in parallel.

10. The toner-fixing heater device according to claim 9, wherein the leading edge and the trailing edge are spaced apart circumferentially to provide a spacing therebetween extending inclinedly at the inclination angle.

11. A toner-fixing heater device for fixing toner on a printing medium comprising:

an insulator film;

a heater strip fixedly arranged in a meandering pattern on the insulator film; and a heater electrode fixedly arranged on the insulator film so as to be electrically connected with the heater strip and extending along a side of the insulator film, the heater electrode having leading and trailing edges formed in parallel to each other and extending along the insulator film in a direction forming an angle of less than 90° with the side of the insulator film.

12. The toner-fixing heater device according to claim 11, further comprising:

a brush electrode disposed slidably on the heater electrode for supplying an electric power to the heater strip through the heater electrode; and a cylindrical roller to which the insulator film is attached with the heater electrode being held in a ring shape, the leading edge and the trailing edge being arranged closely to each other to enable continuous sliding contact of the brush electrode with the heater electrode during a rotation of the roller body.

13. The toner-fixing heater device according to claim 12, wherein the leading edge and the trailing edge are spaced apart from each other circumferentially.

14. The toner-fixing heater device according to claim 12, wherein the leading edge and the trailing edge are overlapped one atop the other circumferentially.

15. The toner-fixing heater device according to claim 14, wherein the trailing edge is laid on the leading edge thereby to enable the brush to slide on the heater electrode without directly contacting the trailing edge.

16. A heater device for use with a brush, comprising:

an insulator film formed into a cylindrical shape;

a heater strip fixedly arranged in a meandering pattern on the insulator film for generating heat when supplied with electric power;

a heater electrode fixedly arranged on the insulator film and electrically connected with the heater strip to supply the electric power to the heater strip while sliding on the brush, the heater electrode extending along a circumferential side of the insulator film and having a leading edge and a trailing edge formed substantially in parallel to each other, the edges being extending along a surface of the insulator film in a direction non-perpendicular to the circumferential side of the insulator film and having a distance therebetween in a circumferential direction, the distance being shorter than a circumferential width of the brush to enable the brush to contact the edges simultaneously.

17. The heater device according to claim 16, wherein the edges are arranged to extend in a direction forming an angle of less than 90° with the circumferential side of the insulator.

18. The heater device according to claim 16, wherein the edges are spaced apart from each other in the circumferential direction to provide a non-electrode part therebetween.

19. The heater device according to claim 16, wherein the edges are overlapped one atop the other in the circumferential direction to enable the brush to provide a continuous electrode ring having no non-electrode part.

20. The heater device according to claim 19, wherein the trailing edge is laid on the leading edge thereby to enable the brush to slide on the heater electrode without directly contacting the trailing edge.

* * * * *